United States Patent [19]

Schimko

[11] Patent Number: 4,615,187

[45] Date of Patent: Oct. 7, 1986

[54] NEEDLE SELECTION DEVICE ON A KNITTING MACHINE, PARTICULARLY A FLAT KNITTING MACHINE

[75] Inventor: Reinhold Schimko, Aalen-Wasseralfingen, Fed. Rep. of Germany

[73] Assignee: Universal Maschinenfabrik Dr Rudolf Schieber, Fed. Rep. of Germany

[21] Appl. No.: 621,772

[22] Filed: Jun. 18, 1984

[30] Foreign Application Priority Data

Jun. 23, 1983 [DE] Fed. Rep. of Germany ..... 3322673

[51] Int. Cl.[4] ..... D04B 15/66

[52] U.S. Cl. ..... 66/75.2; 66/216; 66/219; 66/221

[58] Field of Search ..... 66/75.2, 216, 219, 221, 66/222, 227

[56] References Cited

U.S. PATENT DOCUMENTS

| | | | |
|---|---|---|---|
| 3,717,014 | 2/1973 | Kohler | 66/75.2 |
| 4,100,767 | 7/1978 | Schieber et al. | 66/75.2 |
| 4,214,460 | 7/1980 | Shima | 66/75.2 |
| 4,414,806 | 11/1983 | Schimko | 66/75.2 |
| 4,481,793 | 11/1984 | Cuche et al. | 66/75.2 |
| 4,490,994 | 1/1985 | Essig | 66/75.2 |

FOREIGN PATENT DOCUMENTS

| | | | |
|---|---|---|---|
| 2236323 | 2/1974 | Fed. Rep. of Germany . | |
| 2107746 | 5/1983 | United Kingdom | 66/75.2 |

*Primary Examiner*—Ronald Feldbaum
*Assistant Examiner*—Mary A. Ellis
*Attorney, Agent, or Firm*—Sughrue, Mion, Zinn Macpeak & Seas

[57] ABSTRACT

In the needle selection device on a knitting machine there are provided knitting needles and jacks arranged to be displaceable in needle channels, and flexible selection shanks with operating butts mounted on the knitting needles or jacks. The selection shanks can be lowered in the needle channels by pressure cam elements moved over the needle channels, and selection elements are also provided controlled selectively by selection magnets and moved over the needle channels. In order to achieve a structure for the device which is mechanically structurally simple, displaceable selection jacks with selection butts are arranged in the needle channels to engage above or below the flexible selection shanks, the selection elements are double-armed pivotable selection flaps with inclined contact surfaces for the displacement of the selection jacks, and the selection magnets are flap-anchoring magnets or solenoids whose armatures when energized hold the selection flaps in the vertical position for forward displacement of the selection jacks.

9 Claims, 7 Drawing Figures

NEEDLE SELECTION DEVICE ON A KNITTING MACHINE, PARTICULARLY A FLAT KNITTING MACHINE

BACKGROUND TO THE INVENTION

The invention relates to a needle selection device on a knitting machine, particularly a flat knitting machine, comprising knitting needles and jacks arranged displaceably in needle channels, and spring-biassed selection shanks, with cantilever ends and with operating butts, connected with the knitting needles or jacks, the selection shanks being lowerable in the needle channels by pressure cam means moved relative to the needle channels, and with selection jacks, each having at least one selection butt, displaceably arranged in the needle channels behind the knitting needles, said selection jacks being displaceable in the needle channels in a controlled manner selectively at selection positions by selection magnet means and being arranged to hold the operating butts of the selection shanks selectively in the lowered position.

From West German published patent application DE-OS No. 22 36 323 there is known one such needle selection device on a circular knitting machine with stationary cam members and a movable cylinder with needle channels. In that device all selection jacks are raised and thereby contact the selection magnets, by which they can be dropped in accordance with the pattern and retracted into their rest positions by means of springs. Separate springs in the needle channels ensure the necessary spring force of the selection shanks. For high-speed flat knitting machines with cam carriages moved back and forth over the needle beds this needle selection device is not suitable either from the point of view of its construction or from the point of view of its manner of operation and speed.

A great problem, particularly with high-speed automatic flat knitting machines with cam carriages movable back and forth over the needle beds, lies in finding the right mechanical-structural formation of the selection components, selection magnets and selection elements mounted on the carriage, such that with simple components one can ensure any desired choice of the knitting needles for knitting or not knitting, with the greatest possible reliability.

SUMMARY OF THE INVENTION

It is an object of the invention to create a needle selection device of the type first referred to above which ensures a needle selection with the simplest possible and most robust parts of the needle selection device moved over the knitting needles, even with high speeds of the knitting machine, and which ensures a long life and little incidence of trouble for the machine even under adverse operating conditions.

This object is achieved in accordance with the invention in that:

(a) the selection shanks are inherently flexible and are engaged from above or below by the displaceable selection jacks, (b) selection members are provided at the selection positions and are controllable selectively by the selection magnet means, (c) the selection members comprise double-armed selection flaps pivotably mounted perpendicular to the needle channels and provided each with an inclined contact surface to engage with the selection butts and to displace the selection jacks, and (d) the selection magnet means comprise flap-anchoring magnets or solenoids having armatures which in the energised state hold the selection flaps in the vertical position for forward displacement of the selection jacks.

If the flap-anchoring magnet or solenoid is energised by a current pulse then its armature holds the selection flap in its vertical position and the selection jack is displaced forwards towards the selection shank with the aid of the inclined contact surface of the selection flap. According to the construction and arrangement of the selection jack this holds the flexible selection shank then in a position in which the needle butt of the knitting needle can be engaged or not engaged by knitting cam members.

If the flap-anchoring magnet or solenoid is not energised by a current pulse, then the selection jack remains in its withdrawn basic position, since the selection flap can pivot unhindered as it runs on the selection butt, and the flexible selection shank is located in a position in which the needle butt can be engaged or not engaged by the knitting cam members.

Preferably, spring rods are provided in contact with one of the lever arms of each selection flap for resilient pivoting of the selection flaps into the vertical position into contact with stop members. In this way one achieves that the selection flaps are automatically returned to the vertical position after a pivotal movement away from the vertical position and that the selection flaps are ready for the next needle selection by means of the flap-anchoring magnets or solenoids.

Permanent magnets are preferably provided opposite the rearward end of the selection jacks in order to hold the selection jacks in the retracted basic position when the flap-anchoring magnets or solenoids are not energised. The holding force can be supplemented by a braking force generated by the selection jacks themselves if the selection jacks are bowed laterally out of the longitudinal plane of the associated needle channels.

As needed the selection butts of the selection jacks can be arranged in a staggered array, in which they are associated with selection flaps with associated flap-anchoring magnets or solenoids arranged in a correspondingly staggered array on the carriage.

Preferably, each selection jack comprises a withdrawal butt which, together with a withdrawal member movable over the needle channel, enables a withdrawal of the selection jack into its basic position.

In one preferred embodiment each selection jack comprises a jack nose which in the forwardly displaced position engages above the rear shank end of the flexible selection shank in its lowered position. In this embodiment the knitting needle is held out of action, against the spring force of the selection shank, by the energised flap-anchoring magnet or solenoid.

In another preferred embodiment each selection jack comprises a flexible jack stem which permanently engages the flexible selection shank resiliently from below and which can be held at either of two height-levels by displacement of the selection jack. The selection blades are preferably the flexible needle blades of spring-bladed needles.

In order to be able to hold the selection jacks at the two height levels, there is preferably provided at the forward end of the jack stem a latching leg substantially perpendicular to the stem and which is provided with two horizontal stepped surfaces, the leg projecting through a recess opening downwards from the needle channel such that the stepped surfaces can come into latching engagement with the underside of the needle bed depending upon the displaced position of the selection jack. The recess is preferably an elongate groove in the underside of the needle bed, especially in the case of flat knitting machines.

The stepped surfaces can extend in both directions of the needle channel, starting from the latching leg. In order to achieve the most compact selection jack possible, they preferably extend however from the latching leg towards the selection jack. With this arrangement the flexible selection blade is urged towards the upper surface of the needle bed against its spring force by the flexible jack stem in the forwardly displaced position of the selection jack in such a manner that its operating butt can be struck by the knitting cam for operating the knitting needle.

BRIEF DESCRIPTION OF THE DRAWINGS

The invention is described in more detail hereinafter with reference to two preferred embodiments, as illustrated in the drawings. In the drawings.

DESCRIPTION OF THE PREFERRED EMBODIMENTS

Figure 1:
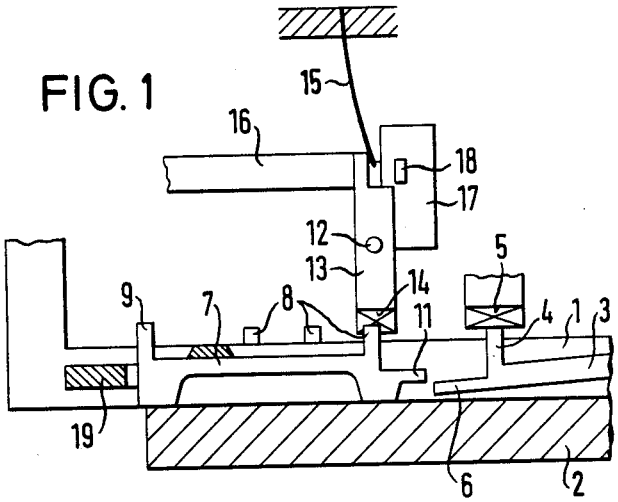
FIG. 1 is a schematic side view, partly in section, of a needle selection device in accordance with the invention above the needle bed of a flat knitting machine with a first preferred embodiment of selection jack withdrawn into the basic position.

In the first preferred embodiment of needle selection device for a flat knitting machine in accordance with the invention as shown in FIGS. 1 to 4 flexible selection shanks 3 are provided in needle channels 1 of a needle bed 2. The selection shanks 3 may be the flexible shanks of knitting needles or of jacks associated with the knitting needles. The selection shanks 3 have operating butts 4 by means of which they can be pressed down into the needle channels by the action of a pressure cam element 5 which is mounted on the carriage. The selection shanks 3 have projecting shank portions 6 at the rear end.

In the needle channels 1 are provided selection jacks 7 which are displaceable at the rear of the selection shanks 3 and which are provided with one or more selection butts 8 and a withdrawal butt 9. This withdrawal butt 9 is engageable with a withdrawal element 10 on the carriage in order to be able to pull the selection jack 7 back into its rearward, basic position. At the forward end of the selection jack 7 there is provided a jack nose 11 which can engage over the top of the shank end 6 of the selection shank 3 when the selection jack 7 is advanced with the shank in its depressed state.

A double-armed selection flap 13 is provided on the carriage at each needle selection position, this flap being pivotable about a pin 12 which extends parallel to the upper surface of the needle bed and perpendicular to the needle channel 1. The selection flap 13 includes at its lower end an inclined contact surface 14 by means of which the selection jack 7 can be displaced towards the selection blade 3 by its engagement with the selection butt 8 with the selection flap 13 in its vertical position. A spring rod member 15 is provided in contact with one of the lever arms of the selection flap 13 and pivots the selection flap 13 resiliently into the vertical position into contact with a stop member 16 which is likewise mounted on the carriage.

Additionally, a flap-anchoring magnet or solenoid 17 is mounted on the carriage for each selection flap 13, with each magnet or solenoid comprising an armature 18. If a current pulse is applied to the flap-anchoring magnet 17 then the armature 18 is drawn into a position in which it holds the selection flap 13 in the vertical position (FIG. 2), whereby the inclined contact surface 14 can be effective to push the selection jack 7 forwards.

Figure 4:
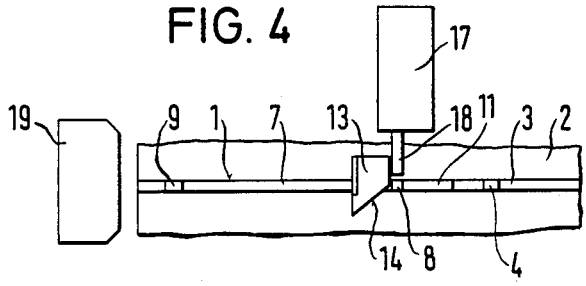
FIG. 4 is a schematic plan view of the device in the position as shown in FIG. 2.

Finally, a permanent magnet 19 is mounted on the carriage in such a manner that it can come into contact with the rear end of the selection jack 7 when the jack is withdrawn into its basic position; the selection jack 7 is thereby held in this withdrawn, basic position. The holding force of the permanent magnet 19 is supplemented by a braking force of the selection jack 7 itself which arises from a for example sideways bowing of the selection jack out of the longitudinal plane of the needle channel (FIG. 4).

In FIG. 1 the needle selection device is shown in a position in which the pressure cam element 5 urges the flexible selection shank 3 into the needle bed 2, so that in consequence the selection jack 7 can be displaced to the right by the selection flap 13 and its jack nose 11 can overlie or engage above the flexible selection shank 3 at its end 6, whereby after release of the butt 4 from the pressure cam element 5 the nose prevents the blade from moving upwards and into operation. In order to be able to carry out this procedure selectively and reliably, the flap-anchoring magnet 17, the spring element 15, the stop member 16 and the permanent magnet 19 are provided. The permanent magnet 19 holds the laterally bowed selection jack 7, which, by its bending, has an additional braking force, in the basic position shown in FIG. 1. If the selection jack 7 is to arrest the selection shank 3 in this position in which it is pressed into the needle channel 1 by the pressure cam element 5 (FIG. 2), then the selection jack 7 must be displaced to the right by the selection flap 13. The flap-anchoring magnet 17 receives a current pulse. The armature 18 moves downwards and then lies in front of the upper lever arm of the double-armed selection flap 13 which is mounted for pivotal movement on the pin 12.

Figure 2:
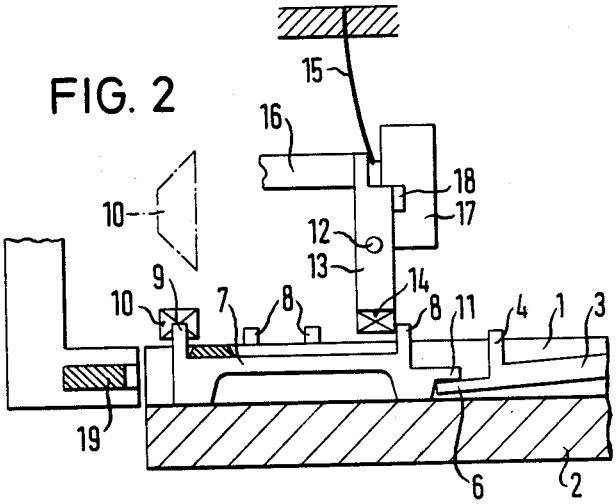
FIG. 2 shows the device as in FIG. 1, but with the selection jack advanced and with a flap-anchoring magnet switched into action.

When this takes place then the jack butt 8 runs on the inclined contact surface 14 and is moved by this from the jack position shown in FIG. 1 to the jack position shown in FIG. 2. The jack nose 11 overlies the resilient end 6 of the selection shank 3 which has been depressed by the pressure cam element 5 and holds this end of the blade in this position after the pressure cam element 5 has released the selection shank 3 again. The operating butt 4 of the selection shank 3 stands outside the cam zone. The following withdrawal member 10 brings the selection jack 7 back again into the basic position. The latching of the jack nose 11 and of the end 6 of the selection shank 3 is uncoupled. The flexible selection shank 3 goes into its basic position (FIG. 3), and the selection jack 7 is held again by the permanent magnet 19. The next selection can then begin.

Figure 3:
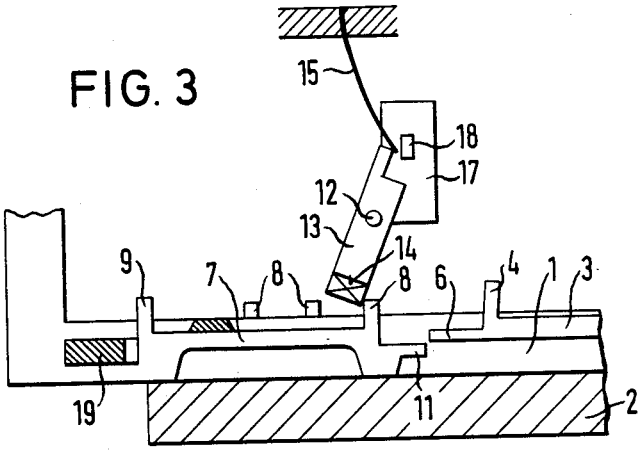
FIG. 3 shows the device as in FIG. 1, with the selection jack held in its basic position and with the selection flap pivoted outwards and with the flap-anchoring magnet not switched into action.

If the selection shank 3, after being pressed down by the pressure cam element 5, is to return again to its initial position, i.e. go back to its working position, then the selection flap 13 does not need to displace the selection jack 7 to the right. After the pressure cam element 5 has urged the selection shank 3 down into the needle bed 2, the flap-anchoring magnet 17 receives no current pulse and the armature 18 remains in the basic position. If now the inclined contact surface 14 on the selection flap 13 approaches the jack butt 8, then the selection flap 13 pivots out to the left (FIG. 3) and the selection jack 7 held by the permanent magnet 19 and its own braking force is not displaced (FIG. 3). After passing the jack butt 8 the spring member 15 brings the selection flap back again into its basic position as shown in FIG. 1, in which the upper lever arm of the selection flap 13 is in contact with the stop member 16.

Figure 5:
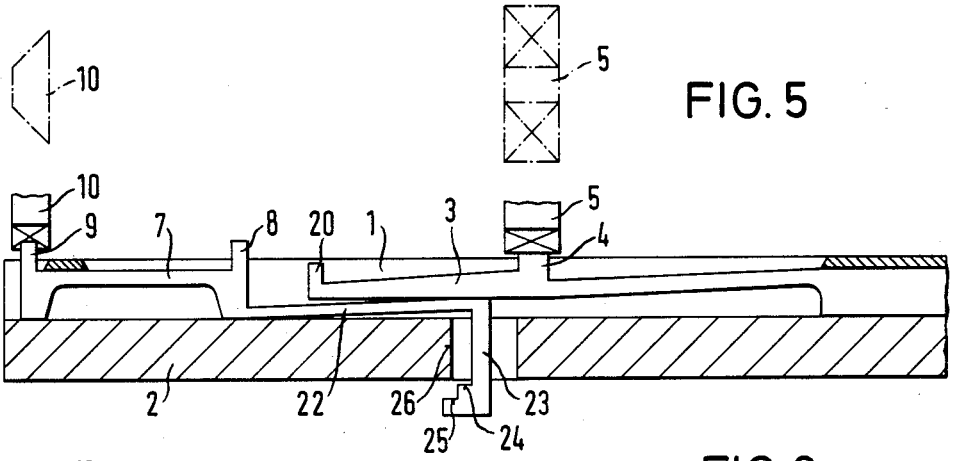
FIG. 5 is a schematic side view of a second preferred embodiment of the invention, showing in particular the formation and arrangement of the selection jack, with the selection jack in its advanced position, ready for needle selection.
Figure 6:
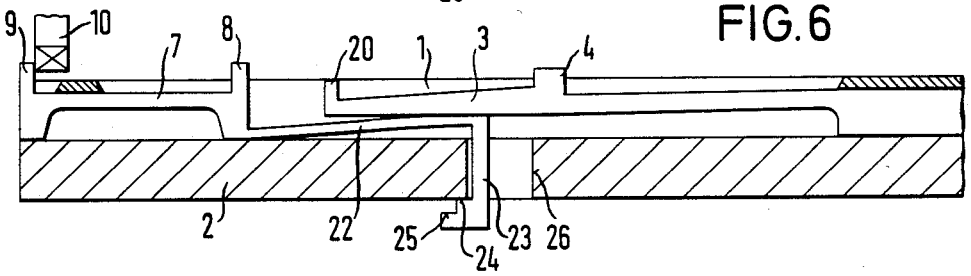
FIG. 6 is a view similar to FIG. 5 with the selection jack withdrawn into the basic position; and, FIG. 7 is a view similar to FIG. 5 with the selection jack advanced and the knitting needle raised.
Figure 7:
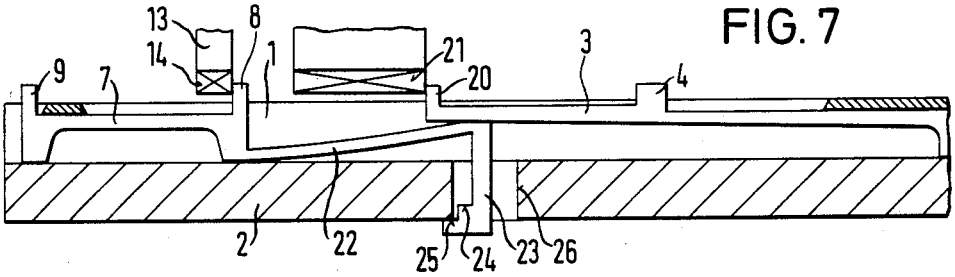

A further preferred embodiment of needle selection device in accordance with the invention is shown in FIGS. 5 to 7. In this embodiment the flexible selection shank 3 is the flexible needle shank of a spring-shanked needle and carries a needle butt 20. In the raised position of the selection shank 3 the needle butt 20 can be struck by knitting cam members 21.

Instead of a jack nose 11 the selection jack 7 here comprises a flexible jack stem 22 which permanently engages the underside of the flexible selection shank 3 and which at its forward end is provided with a substantially vertically downwardly extending latching leg 23 which is provided with two horizontal step surfaces 24 and 25. The needle bed at its rear side includes a recess in the form of a longitudinal slot 26 which opens downwardly from the needle channel 1. The latching leg 23 projects down through the longitudinal slot 26 in such a way that the step surfaces 24 and 25 can each come into latching engagement with the underside of the needle bed 2 depending upon the displaced position of the selection jack 7.

The selection shank 3 here formed as a flexible needle shank stands in its basic position as shown in FIG. 6, while the flexible jack stem 22 will urge the selection shank 3 always into operation, i.e. upwards, by its spring force, as is shown in FIG. 7. The latching leg 23 of the selection jack 7 projects downwards through the longitudinal slot 26 in such a way that the step surfaces 24 and 25, depending upon the displacement of the selection jack, either hold the jack stem 22 and consequently the needle butt 20 in an out-of-operation position (FIG. 6) or allow these components to move into the operating position (FIG. 7).

The pressure cam element 5 (FIG. 5) urges the flexible jack stem 22, by way of the flexible selection shank 3, downwards into the position in which it is non-functioning. In this position all the selection jacks 7 are withdrawn by the withdrawal member 10 into the basic position (FIG. 6) in order subsequently to be able to make a new selection by way of the chosen selection flaps 13 (FIG. 7). When the pressure cam member 5 releases the resilient selection blade 3, then the jack stem 22 springs upwards until the step surface 25 comes into contact with the needle bed edge. The needle lies with its needle butt 20 in the region of the knitting cam member 21, i.e. in the working position.

If the selection flap 13 is not chosen, then the selection jack 7 is not displaced to the right (FIG. 6). If now the pressure cam member 5 releases the flexible selection shank 3, then the jack stem 22 springs upwards until the step surface 24 comes into contact with the needle bed edge. The needle then remains with its needle butt 20 in the needle channel 1, i.e. outside the region of the knitting cam member 21 and thus in a non-functioning position. The selection choice follows as described above in connection with the first embodiment with reference to FIGS. 1 to 4.

I claim:

1. A needle selection device on a knitting machine, especially a flat knitting machine, comprising knitting needles and jacks arranged displaceably in needle channels, and spring-biassed selection shanks, with cantilever ends and with operating butts, connected with the knitting needles or jacks, said selection shanks being lowerable in the needle channels by pressure cam means moved relative to the needle channels, and with selection jacks, each having at least one selection butt, displaceably mounted in the needle channels behind the knitting needles, said selection jacks being displaceable in the needle channels in a controlled manner selectively at selection positions by selection magnet means and being arranged to hold the operating butts of the selection shanks selectively in the lowered position in which:

(a) the selection shanks are inherently flexible and are engaged by the horizontally displaceable selection jacks, (b) selection members are provided at the selection positions and are controlled selectively by the selection magnet means, (c) the selection members comprise double-armed selection flaps pivotably mounted perpendicular to the needle channels and provided each with an inclined actuation surface for engaging the selection butts and thereby displacing the selection jacks, and (d) the selection magnet means comprise flap-anchoring magnets or solenoids having armatures which in the attracted state hold the selection flaps in the vertical position for forward displacement of the selection jacks.

2. A needle selection device according to claim 1, which includes spring means in contact with one of the lever arms of each selection flap for resilient pivoting of the selection flap into the vertical position into contact with a stop member.

3. A needle selection device according to claim 1, which includes permanent magnet means provided opposite the rearward end of the selection jacks.

4. A needle selection device according to claim 1, in which each selection jack comprises a withdrawal butt which, together with a withdrawal member movable over the needle channel, enables a withdrawal of the selection jack into a basic position thereof.

5. A needle selection device according to claim 1, in which each selection jack comprises a jack nose which in an advanced position engages above the rearward shank end of the flexible selection shank in its lowered position.

6. A needle selection device according to claim 1, in which each selection jack comprises a flexible jack stem which permanently engages the flexible selection shank resiliently from below and which can be locked at two height levels by displacement of the selection jack.

7. A needle selection device according to claim 6, which includes at the forward end of each jack stem a latching leg extending substantially perpendicular to the stem and having two horizontal stepped surfaces, said leg projecting through a recess opening downwards from the needle channel such that the stepped surfaces can come into latching engagement with the underside of the needle bed depending upon the displaced position of the selection jack.

8. A needle selection device according to claim 7, in which the recess is an elongate groove in the underside of the needle bed.

9. A needle selection device according to claim 7, in which the stepped surfaces extend in the direction from the latching leg towards the selection jack.

* * * * *

UNITED STATES PATENT AND TRADEMARK OFFICE

CERTIFICATE OF CORRECTION

PATENT NO. 4,615,187

DATED : October 7, 1986

INVENTOR(S) : Reinhold Schimko

It is certified that error appears in the above-identified patent and that said Letters Patent is hereby corrected as shown below:

On the title page, Assignee should read

-- [73] Assignee: Universal Maschinenfabrik Dr. Rudolf Schieber GmbH & Co. KG
Federal Republic of Germany --.

Signed and Sealed this

Fourteenth Day of April, 1987

*Attest:*

DONALD J. QUIGG

*Attesting Officer*

*Commissioner of Patents and Trademarks*